US005522626A

United States Patent [19]

Dominique

[11] Patent Number: 5,522,626

[45] Date of Patent: Jun. 4, 1996

[54] LOCK WITH ASSISTED CLOSURE ESPECIALLY FOR A MOTOR VEHICLE DOOR

[75] Inventor: Benoit Dominique, Champfronier, France

[73] Assignee: MGI-Coutier, Paris, France

[21] Appl. No.: 365,297

[22] Filed: Dec. 28, 1994

[30] Foreign Application Priority Data

Dec. 28, 1993 [FR] France ..... 93 15749

[51] Int. Cl.[6] ..... E05C 3/12

[52] U.S. Cl. ..... 292/198; 292/216; 292/DIG. 23; 292/DIG. 72

[58] Field of Search ..... 292/198, 216, 292/DIG. 23, DIG. 72

[56] References Cited

U.S. PATENT DOCUMENTS 4,907,831 3/1990 Di Giusto ..... 292/216

5,150,933 9/1992 Myslicki et al. ..... 292/DIG. 72 X

*Primary Examiner*—Rodney M. Lindsey

*Attorney, Agent, or Firm*—Wolf, Greenfield & Sacks

[57] ABSTRACT

Lock including at least one latch (2) which can move against a spring (8) between a locked position and a retracted position, this displacement of the latch taking place against the spring which thus passes from a position known as the rest position to a position known as the tension position, this also including a means (6, 7) for holding the spring (8) in its so-called tension position, and a means (17) actuated by the keeper when it engages with the latch and actuating this holding device so as to release the spring, the lock being characterized in that it includes a means (26) actuated when the door is being opened so as to play a part in tensioning the spring (8).

11 Claims, 5 Drawing Sheets

LOCK WITH ASSISTED CLOSURE ESPECIALLY FOR A MOTOR VEHICLE DOOR

Figure 1:
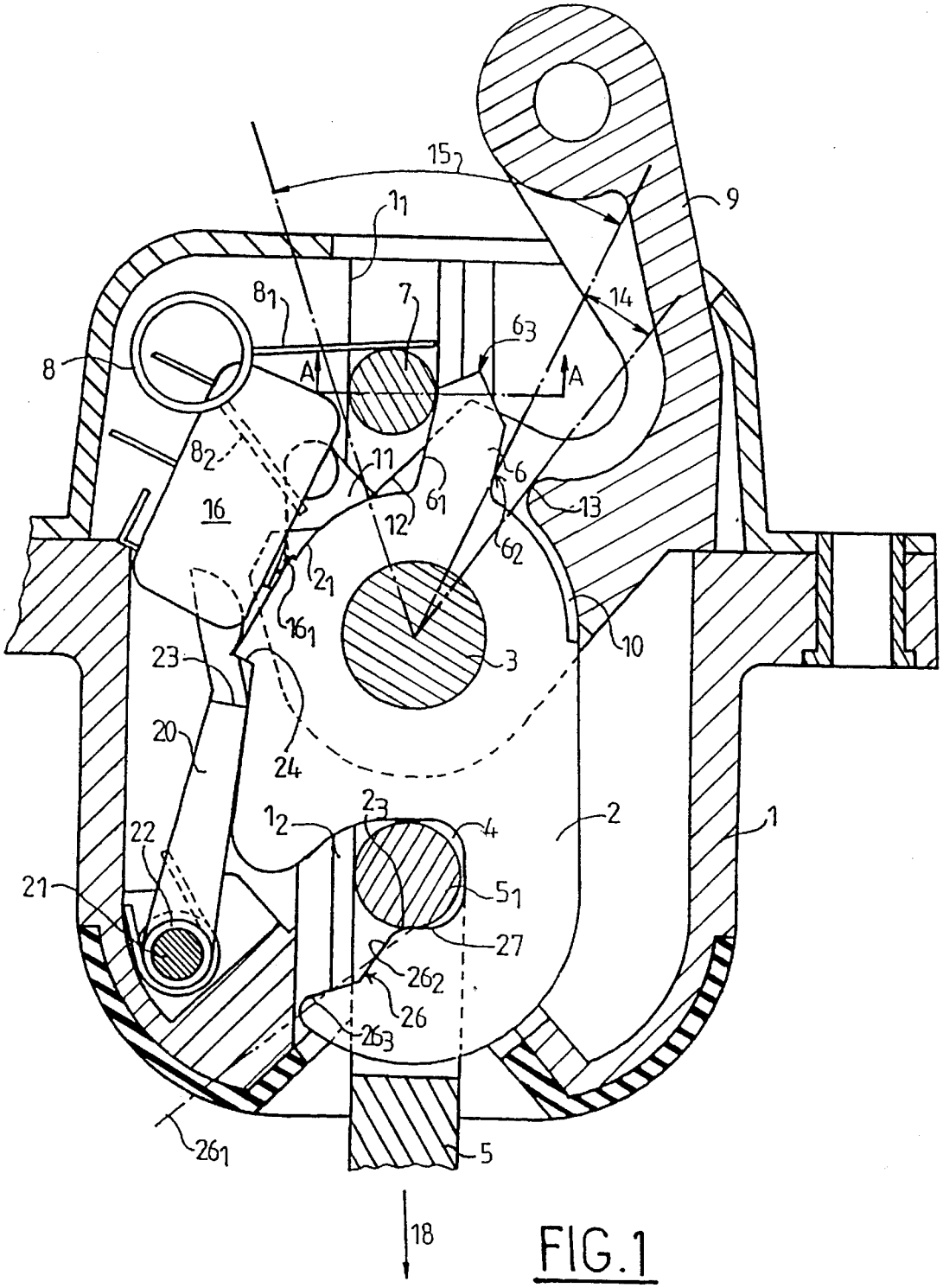

The lock of the invention includes at least one latch which can move against a spring between at least one locked position for which it interacts with the keeper of the lock and a retracted position for which it allows its disengagement from or engagement with the keeper, this displacement of the latch from the looked position to the retracted position taking place against the spring which thus passes from a position known as the rest position to a position known as the tension position, this lock also including a means for holding the spring in its so-called tension position and a means actuated by the keeper when it engages with the latch and actuating this holding device so as to release the spring, the lock being characterized in that it includes a means actuated when the door is being opened so as to play a part in tensioning the spring.

According to another characteristic of the invention, the means actuated when the door is being opened for tensioning the spring consists of the keeper interacting with the latch during disengagement of the keeper, from the lock.

According to another characteristic of the invention, the means actuated by the keeper during its disengagement from the latch so as to play a part in tensioning the spring, consists of the latch itself which has a surface for interaction with the keeper pointing obliquely relative to the direction of the relative displacement of the lock and of the keeper.

According to another characteristic of the invention, the lock includes a pawl interacting with the latch so as to constitute a catch for locking the door in a position corresponding to partial or total closure of this door.

Figure 2:
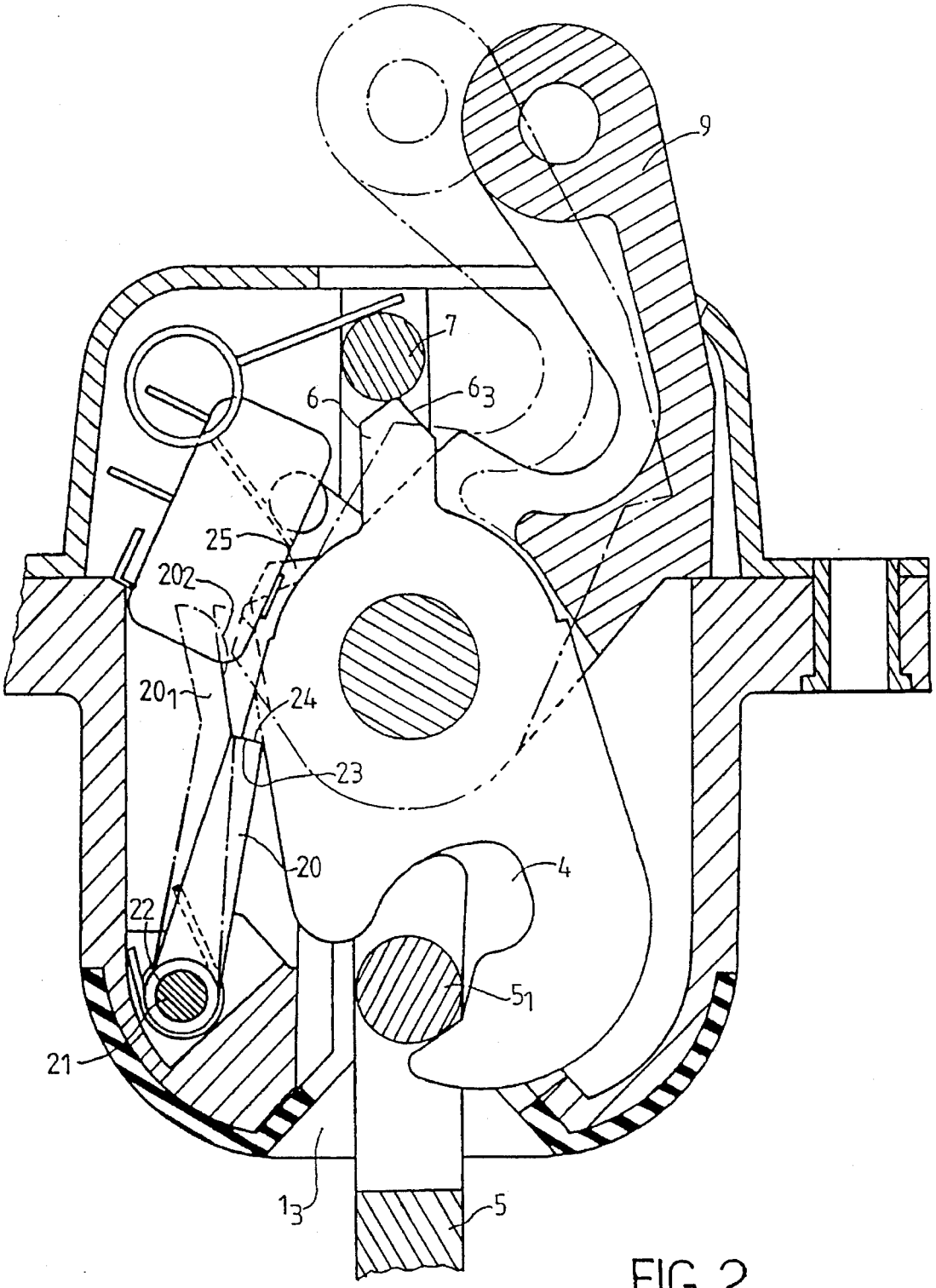
Figure 3:
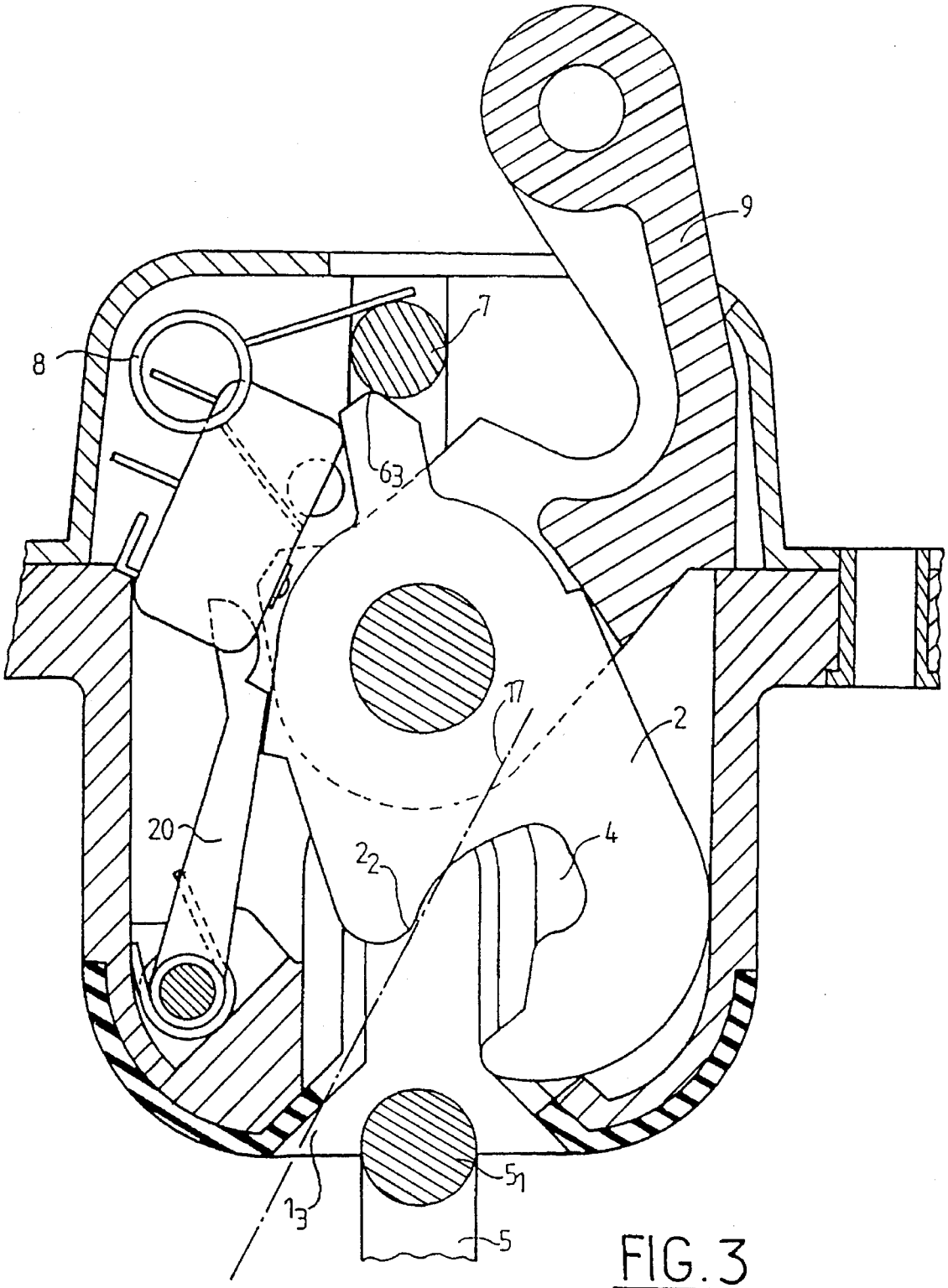
Figure 4:
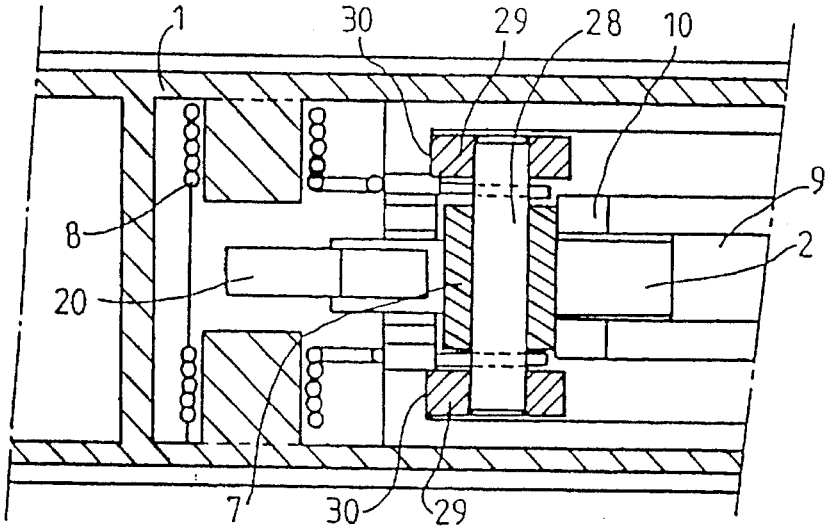
Figure 5:
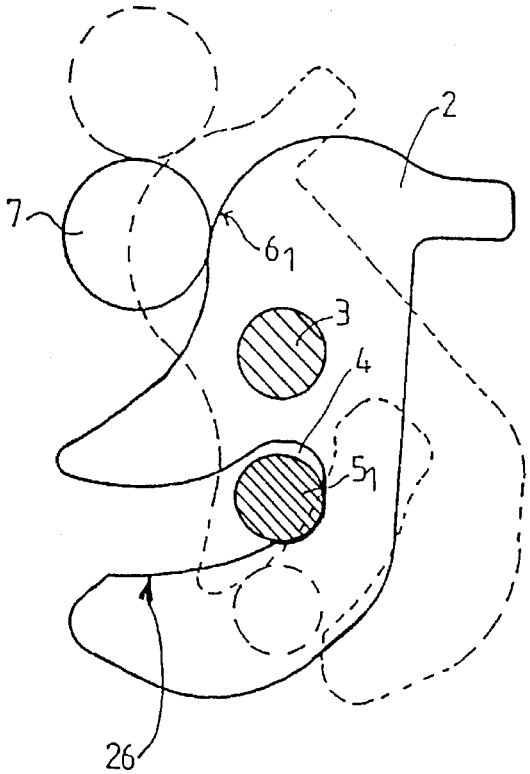
Figure 6:
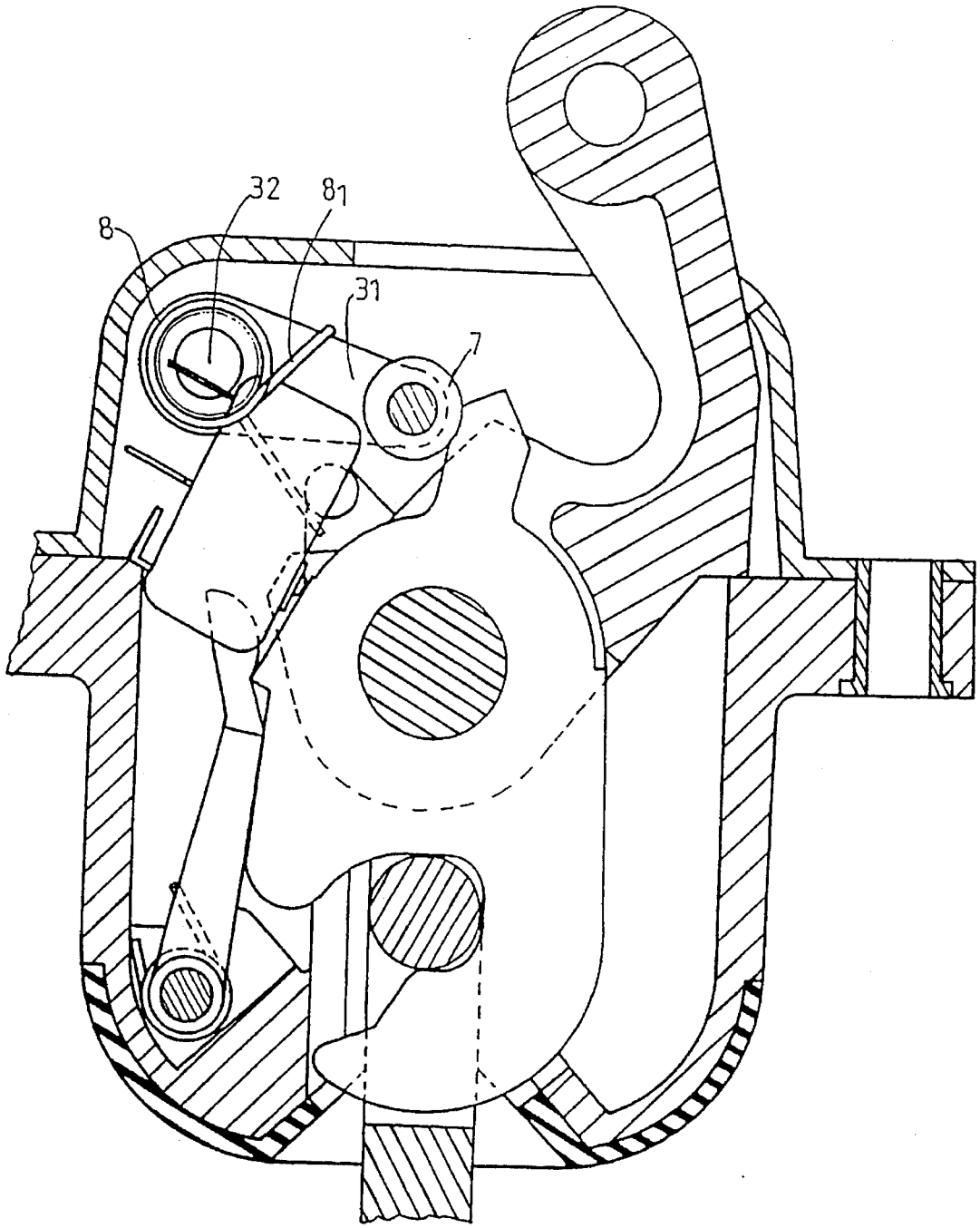

The invention is represented by way of non-limiting example in the drawings appended hereto in which:

FIGS. 1, 2 and 3 represent, in section, one embodiment of a lock respectively in its state of total closure, in its state of partial closure, and in its open state, FIG. 4 is a view in section, on A—A of FIG. 1, of another embodiment of the pusher located between the latch and the spring, FIG. 5 is a diagrammatic view of another embodiment of the latch, FIG. 6 is a sectional view of the lock of FIGS. 1, 2 and 3 making use of another embodiment of the pusher.

The object of the present invention is consequently to produce a lock for a motor vehicle, with assisted closure, also known as lock with fully-enclosed latch, in which the energy released and used to achieve this assisted closure is stored up while the door is being opened, that is to say, in the example represented, while the lock is being opened.

In effect, according to the example represented, the arming of the lock in order to store up the energy is obtained by the keeper which causes the latch to pivot against a spring while the keeper and the latch are separated while the door is being opened. According to a modified embodiment, provision could, however, be made for the spring to be tensioned directly through the action of opening the door, the spring or the latch in this case being connected by a linkage to a fixed point on the door frame, on the side which receives the hinges. This arrangement would have the advantage of allowing a much more substantial accumulation of energy.

The present description relates to a motor vehicle door lock but applies equally well to vehicle bonnets and boot lids, it being specified, however, that in general, in the case of doors, the lock is fixed to the door wing and the keeper to an upright, whilst for boots and bonnets, the reverse arrangement is generally envisaged.

The look represented in FIGS. 1 to 3 comprises a two-part case 1 inside which the latch 2 is mounted so that it can pivot on a spindle 3. This latch is produced in the form of a hook and includes a housing 4 for receiving the crosspiece $\mathbf{5}_1$, generally circular in cross-section, of the latch 5.

This latch is also provided with a finger 6 pointing substantially radially, on which there acts a pusher 7 produced in the form of a cylindrical roller of circular cross-section or of a ball and which can move under the action of the spring 8 in a slot $\mathbf{1}_1$ of the case. This slot points generally towards the spindle 3 of the latch so that the pusher 7 tends to press on the edge $\mathbf{6}_1$ of the finger 6 which is located obliquely relative to the guide slot $\mathbf{1}_1$ of the pusher 7 and/or to the circular path of the latch 2.

According to this arrangement, the pusher 7 moving in the slot $\mathbf{1}_1$, acts on the latch 2 like a wedge so that, in the locked position of the lock (FIG. 1), the spring 8 tends to cause this latch to turn in the clockwise direction so as to grip the crosspiece $\mathbf{5}_1$ of the keeper effectively, and therefore without play, between the wall $\mathbf{1}_2$ of the case and the bottom of the housing 4 of the latch.

A lever 9 which constitutes the lever for actuating the lock and is, for this purpose, connected to an operating linkage or any other control member is also mounted so that it can pivot about the spindle 3 or about any other spindle.

This lever is mounted on the spindle 3 so that it can pivot via a fork-shaped end 10 which surrounds the latch 2 with its two branches. This lever 9 is integral with a projection 11 on which the second branch $\mathbf{8}_2$ of the spring 8 comes to bear. This projection and this spring are thus located so as constantly to tend to cause the lever 9 to pivot towards its rest position which, in the present case, is in the clockwise direction. This lever 9 has a surface 12 which is inclined relative to the direction of movement of the pusher 7 in the guide slot $\mathbf{1}_1$ and/or relative to the circular path of the lever, this inclination being greater than the inclination of the surface $\mathbf{6}_1$ so that it constitutes a cam lobe capable of interacting with the pusher 7 in order to displace it against the spring 8 when the lever 9 is pivoted in the anticlockwise direction, so as to open the lock.

The lever 9 also includes a rim 13 which is intended to come to bear against the flank $\mathbf{6}_2$ of the finger 6 when the lever 9 is pivoted in the anticlockwise direction.

This rim 13 is located relative to the flank $\mathbf{6}_2$ such that the lever 9 can pivot through an initial travel 14 before coming to bear on the flank $\mathbf{6}_2$ of the finger 6 and actuating the latch.

Moreover, the cam lobe 12 is arranged so that it pushes the pusher 7 back against the spring 8 during this initial travel 14 of the lever 9. Thus, when the rim 13 is applied against the flank $\mathbf{6}_2$ of the finger 6, the finger 6 is no longer wedged by the pusher 7 and the lever 9 can then continue its pivoting motion along the path 15 during which the latch 2 pivots in the anticlockwise direction whilst the end $\mathbf{6}_3$ of the finger 6, sliding over the circular surface of the pusher 7, is placed in the position represented in FIG. 3 for which this end $\mathbf{6}_3$ is displaced beyond the vertical line passing through the axis of the pusher 7.

The pusher 7, on which the spring 8 acts, therefore constitutes a member for holding the latch 2 in this angular position (FIG. 3) which corresponds to the retracted position of the latch (unlocked or open position of the lock), for which the keeper 5 can disengage from the hook-shaped housing 4 of this latch. It should be noted that the latch may be held in place by any other solution and, for example, a second pawl.

The latch 2 also has a peripheral surface $2_1$ which constitutes a cam surface for actuating the finger $16_1$ of an electric switch 16. This finger $16_1$ and this cam surface $2_1$ are arranged so as to manoeuvre the switch at the beginning of the pivoting motion of the latch 2, that is to say when the door is being opened.

The case 1 of the lock includes a pawl 20 mounted so that it can pivot on a spindle 21 and arranged under the action of a spring 22 which tends to cause this pawl to pivot towards the latch 2, so that the rim 23 with which it is provided can interact with the catch 24 of the latch 2 as it pivots in the direction of opening of the lock. This pawl thus makes it possible to immobilize the latch in a looked partially closed position (FIG. 2) for which the crosspiece $5_1$ of the keeper 5 is still retained in the housing 4 of the latch.

The opening lever 9 is also provided with a peripheral projection 25, whilst the pawl 20 is provided with an extension $20_1$ ending in a boss $20_2$. This projection 25 and this boss $20_2$ are arranged so that the projection 25 interacts with the boss $20_2$ to cause the pawl 20 to pivot in the anticlockwise direction and thus disengage the rim 23 of the catch 24 during the initial free travel 14 of the lever 9 in order to allow the door to be opened.

In contrast, as long as the lever 9 is not actuated to cause the door to open, the pawl 20 is held against the latch 2 so as to prevent the lock from being open beyond its partially closed position represented in FIG. 2.

Thus, when the lock is in the closed position (FIG. 1) and if for some reason, for example an impact, the pusher 7 is lifted and the latch 2 starts to pivot in the direction for opening the lock, the pivoting of this latch is halted through the interaction of the catch 24 with the rim 23, in the partially closed position represented in FIG. 2 for which the keeper is still retained in the housing 4 of the lock to prevent the door from being opened totally. It should be noted that this pawl may also serve to hold the latch in the totally closed position.

The housing 4 of the latch 2 is produced in the form of a slit and has an arrangement such that when the door is opened, the disengagement of the keeper 5 from the case of the lock plays a part in tensioning the spring 8 in order to store up energy while the door is being opened, this energy then being restored during closure of the door in order to assist this closure operation and thus achieve a "fully-enclosed latch" lock in which the storage of the required energy is achieved when the door is being opened.

According to the example represented, this storage of energy is obtained through the interaction of the keeper with the rim 26 of the housing 4 of the latch, of which the average slope line $26_1$ points obliquely relative to the direction 18 of relative displacement of the keeper relative to the lock.

Thus, when opening the look by operating the lever 9 and as soon as the boss 13 acts on the finger 6 to cause the latch 2 to pivot against the spring 8 and by displacing the pusher 7, the crosspiece $5_1$ of the keeper leaves the flat 27 of the housing 4, so that the action of opening the door which tends to separate the lock from the keeper (or vice versa) tends to cause the latch 2 to tilt in the anticlockwise direction, owing to the interaction of the crosspiece $5_1$ of the keeper with the oblique surface 26.

According to the example represented, the oblique surface 26 is made in two parts $26_2$ and $26_3$, the first, $26_2$, which is the closest to the bottom of the housing 4 having a shallower slope than the part $26_3$ relative to the direction of relative displacement 18 of the latch and the keeper. These parts $26_2$ and $26_3$ are arranged so that, for the partially closed position, when the catch 24 comes to bear on the rim 23 of the pawl 20, the crosspiece $5_1$ has finished acting on the part $26_2$ of the oblique surface 26 and is in contact with the part $26_3$ whilst the angular position of the latch 2 is such that the spring 8, pushed back by the pusher 7 and the finger 6, is substantially in its state of maximum compression (see FIG. 2).

Thus, at the beginning of the pivoting motion of the latch 2, initiated by actuating the lever 9, the disengagement of the keeper 5 from the case of the lock when the door is being opened brings the crosspiece $5_1$ to interact with the shallow slope part $26_2$ of the latch so that this suitable demultiplication of the motion of the latch allows the pusher 7 to be pushed back easily against the spring 8, this motion moreover being initiated by the lobe 12 of the lever 9.

When the spring is in its compressed state (FIG. 2) and the pusher 7 is substantially at the top $6_3$ of the finger 6, the action of opening the door continues, then making the crosspiece $5_1$ interact with the more steeply sloping part $26_3$, the force developed for causing the latch 2 to pivot being in this case greater, which has no drawback because at this stage the latch 2, to pivot in the anticlockwise direction, need only provide a minimal compression of the spring 8.

In contrast, as soon as the top $6_3$ of the finger 6 has moved beyond the midplane of the pusher 7, the spring 8 tends to promote the pivoting of the latch 2 in the anticlockwise direction, until the keeper is completely released (FIG. 3). At this stage, the latch is held in its retracted state through action of the spring 8 on the finger 6 via the pusher 7, this spring 8 being in the stretched state so as to constitute a store of energy which can be released when the door is closed.

During this closure of the door, the crosspiece $5_1$ of the keeper 5 penetrates the tapered entry $1_3$ of the case 1 and is housed directly in the opening of the housing 4 of the latch, without encountering any obstacle.

During this relative motion of the case of the lock and of the keeper, the crosspiece $5_1$ of circular cross-section of the keeper first of all comes to bear at $2_2$ on the latch 2 along a tangential surface 17 which is oblique relative to the direction of relative displacement of the case of the lock and of the keeper and/or oblique relative to the circular path of the latch, so that the moving-together of the keeper and of the lock corresponds to a slight pivoting of the latch 2 in the clockwise direction. This pivoting has sufficient amplitude for the end $6_3$ of the finger 6 to pass to the side opposite the vertical line passing through the axis of the pusher 7. At this stage, the pusher 7 and its actuating spring 8 are released so that they interact with the lobe $6_1$ so as to tend to cause the latch to pivot in the clockwise direction.

The spring 8 then acts as a driving member, releasing the energy initially accumulated while the door was being opened so that it tends to cause the latch 2 to pivot in the direction of its closure, and therefore the closure of the door.

It is thus noticed that during an action of closing the door and if the door is incorrectly closed, it can become placed in the partly closed position (FIG. 2) but, in this case, tensioned spring 8, interacting with the lobe $6_1$, tends to cause the latch 2 to pivot in the clockwise direction and therefore to exert a pulling force on the keeper until the crosspiece $5_1$ is brought into the bottom of the housing 4 (FIG. 1).

The lock in accordance with the invention is therefore a lock with fully-enclosed latch having a safety catch on opening, owing to the pawl 20, but in which the partially closed position is not truly a stable position since, in this state, the spring 8 tends to return the latch to its position of FIG. 1, which corresponds to completing the motion of closing the door of the vehicle, compressing the seals.

During this motion of closing the door, the crosspiece $5_1$ of the keeper also interacts with a curved surface $2_3$ which is inclined relative to the relative displacement 18 of the lock and of the keeper, so that the latch 2, under the action of the spring 8, tends to place the crosspiece $5_1$ of the keeper at the bottom of the housing 4 on the flat 27, this flat pointing so that a pulling force exerted on the keeper does not cause the latch to pivot.

According to FIGS. 1 to 3, the pusher 7 consists of a cylindrical roller or of a ball which can move in lateral slots $1_1$ of the case 1 of the lock. This roller 7 could equally well be produced in the way represented in FIG. 4,according to which it is mounted so that it can rotate freely on a spindle 28, the ends of which receive, so that they can rotate freely, rollers 29 moving by rolling over runway surfaces 30 of the case 1 of the lock.

Also, as is represented in FIG. 6, the roller 7 could be mounted so that it rotates freely at the end of an arm 31 mounted so that it can pivot on a spindle 32. In this case, the spring 8 is preferably located around the spindle 32, one of its ends $8_1$ bearing on the lever 31.

It is clearly understood that the shapes of the constituent parts of the lock are not limited to those represented in the drawings, it being understood that the same functions could be obtained with modified shapes of these parts.

Thus, in FIG. 5, another shape of a latch 2 has been represented, by way of example, this latch interacting with the pusher 7 and the crosspiece $5_1$ of the keeper, this FIG. 5 also representing, in broken line, the position of the latch 2, of the pusher 7 and of the keeper 5 in the unlocked state of the lock.

I claim:

1. A lock for use on a motor vehicle door, the lock comprising:

a keeper;

a spring;

a latch pivotally mounted between a locked position and an unlocked position, the latch engaging the keeper in the locked position and disengaging from the keeper in the unlocked position, the latch displacing the spring from a rest position to a tension position as the latch pivots from the locked position toward the unlocked position;

tensioning means for placing the spring in the tension position, the tensioning means disposed on the latch and being actuated when the door is opened;

retention means for holding the spring in the tension position when the latch is in the unlocked position; and releasing means for releasing the retention means so that the spring is released from the tension position urging the latch to pivot toward the locked position, the releasing means disposed on the latch and being actuated when the keeper engages the latch as the door is closed.

2. The lock in accordance with claim 1, wherein the tensioning means includes the keeper interacting with the latch as the keeper is being disengaged from the latch in a disengagement direction.

3. The lock in accordance with claim 2, wherein the latch has a first surface for engaging the keeper as the keeper is being disengaged from the latch, the first surface being oblique relative to the disengagement direction.

4. The lock in accordance with claim 3, further comprising a pawl for locking the door in a partially closed position, the pawl engaging the latch in a locked partially closed position between the locked position and the unlocked position.

5. The lock in accordance with claim 4, wherein the pawl engages the latch so that the spring is displaced between the rest position and the tension position, the spring urging the latch toward the locked position so that the first surface interacts with the keeper causing the door to completely close.

6. The lock in accordance with claim 5, wherein the latch has a second surface for engaging the keeper in the locked position, the second surface being oriented relative to the disengaging direction so that a pulling force exerted on the keeper in the disengaging direction does not cause the latch to pivot.

7. The lock in accordance with claim 4, further comprising a lever that actuates the latch to pivot toward the unlocked position, the lever including a boss that disengages the pawl from the latch before the lever actuates the latch.

8. The lock in accordance with claim 7, wherein the tensioning means includes a cylindrical pusher disposed between the spring and the latch, the pusher comprised of a pivoting arm and a roller rotatably mounted on the arm, the spring engaging the arm and the latch engaging the roller.

9. The lock in accordance with claim 8, wherein the arm is pivotally mounted to a spindle, the spindle supporting the spring.

10. The lock in accordance with claim 1, wherein the tensioning means includes a cylindrical pusher disposed between the spring and the latch, the pusher being rotatably mounted on a spindle having a roller for guiding the spindle along a roller track so that the spindle can move relative to the latch.

11. A lock comprising:

a keeper;

a latch pivotally mounted between a locked position and an unlocked position, the latch constructed and arranged to engage the keeper in the locked position and to disengage from the keeper in the unlocked position;

a spring;

a pusher disposed between the latch and the spring, the pusher constructed and arranged to displace the spring to a tension position as the latch pivots from the locked position toward the unlocked position and to retain the latch in the unlocked position; and a lever constructed and arranged to release the pusher and to pivot the latch from the unlocked position toward the locked position, the spring being released from the tension position to urge the pusher against the latch to pivot the latch toward the locked position.

* * * * *